US006136145A

United States Patent [19]

Henricson et al.

[11] Patent Number: 6,136,145

[45] Date of Patent: Oct. 24, 2000

[54] METHOD FOR TREATING PULP IN AN INDIRECT HEAT EXCHANGER IN CONNECTION WITH BLEACHING

[75] Inventors: Kaj O. Henricson, Helsinki; Olavi E. Pikka, Karhula, both of Finland

[73] Assignee: Andritz-Ahlstrom Oy, Espoo, Finland

[21] Appl. No.: 08/981,419

[22] PCT Filed: Jun. 14, 1996

[86] PCT No.: PCT/FI96/00353

§ 371 Date: Dec. 16, 1997

§ 102(e) Date: Dec. 16, 1997

[87] PCT Pub. No.: WO97/00998

PCT Pub. Date: Jan. 9, 1997

[30] Foreign Application Priority Data

| | | | |
|---|---|---|---|
| Jun. 20, 1995 | [FI] | Finland | 953064 |
| Sep. 7, 1995 | [FI] | Finland | 954185 |
| Sep. 19, 1995 | [FI] | Finland | 954407 |

[51] Int. Cl.[7] ..... D21C 11/06; D21C 9/10

[52] U.S. Cl. ..... 162/47; 162/67; 162/68; 162/78

[58] Field of Search ..... 162/63, 68, 47, 162/78, 67, 375, 207

[56] References Cited

U.S. PATENT DOCUMENTS

| | | | |
|---|---|---|---|
| 2,606,114 | 8/1952 | Lewis | 92/7 |
| 4,798,652 | 1/1989 | Joyce et al. | 162/60 |
| 4,849,052 | 7/1989 | Grant | 162/39 |
| 5,217,575 | 6/1993 | Backlund | 162/65 |

FOREIGN PATENT DOCUMENTS

| | | |
|---|---|---|
| 0275502 | 7/1988 | European Pat. Off. . |
| WO 94/10376 | 5/1994 | WIPO . |
| WO 96/01920 | 1/1996 | WIPO . |

OTHER PUBLICATIONS

McDonald, R. G. "The Pulping of Wood", vol. 1, 2nd Edition, pp. 586–588, 1969.

Stromberg, M. "1994 International Pulp Bleaching Conference", pp. 199–202, Fig. 1–14.

Allen et al, "Spiral Heat Exchangers Preheat High Solids Black Liquor Without Plugging," Pulp & Paper, Feb., 1991, pp. 60–63.

*Primary Examiner*—Dean T. Nguyen
*Attorney, Agent, or Firm*—Nixon & Vanderhye P.C.

[57] ABSTRACT

A method of treating pulp and an apparatus for practicing the method are particularly suitable for the bleaching of medium consistency pulp when bleaching stages of varying temperature are used. Chemical pulp is treated in such a way that the pulp is allowed to flow prior to a bleaching reactor, in the reactor itself, and/or after the reactor, at a velocity of less than 5 m/s through an indirect heat exchanger in order to change the pulp temperature more than 5° C., preferably more than 10° C.

24 Claims, 5 Drawing Sheets

METHOD FOR TREATING PULP IN AN INDIRECT HEAT EXCHANGER IN CONNECTION WITH BLEACHING

CROSS-REFERENCE TO RELATED APPLICATION

This is the U.S. national phase of PCT/FI96/00353 filed Jun. 14, 1996.

BACKGROUND AND SUMMARY OF THE INVENTION.

The present invention relates to a method of treating pulp and to an apparatus for applying the method. The primary object of the invention is to develop a method and an apparatus for treating pulp at a temperature which as precisely as possible meets the requirements of the treatment, and thereby to optimize the process with respect to also the temperature. A particular object of the invention is a method of bleaching pulp with a sequence using chlorine dioxide, in as environmentally friendly a way as possible. The method of the invention is especially suitable for small-scale rebuilds of existing pulp mills, which are based on use of elemental chlorine and chlorine dioxide. A second object of the invention is an elemental chlorine free bleaching sequence, which is suitable for places where chlorine dioxide is, however, desired to be used. Use of chlorine dioxide is, however, minimized in the sequence by arranging for optimal process conditions for chlorine dioxide in the dioxide bleaching, whereby the AOX number of effluents may be maintained very at a very low level. The invention also relates to an apparatus used, e.g., in bleaching, which apparatus enables a significant reduction of steam consumption at the mill. Especially, reduction in use of high-pressure steam is concerned because the mills often have more than enough low-pressure steam, but in some cases the mill is not even capable of producing as much high-pressure steam as the heating requires. The invention also relates to treatments which are effected with other bleaching and treatment chemicals, and in which the treatment temperature needs to be changed between different stages.

Pulp mills are nowadays trying to get rid of use of elemental chlorine and partly also of chlorine dioxide. Reasons for this are both environmental protection and market factors. Drawbacks caused by elemental chlorine are clearly noticeable malodorous gaseous emissions as well as liquid discharges from pulp mills to water-courses. Liquid chlorine dioxide is not so much of a nuisance as for its odour, but it has drawbacks which mainly affect watercourses. However, when these chlorine chemicals are compared with each other by means of the AOX number, which indicates their load on the water-courses, it can be seen that the harmfulness of elemental chlorine is multiple in comparison with that of chlorine dioxide. The AOX number of chlorine is about 4 to 7 and that of chlorine dioxide about 1 to 1.5 or even slightly below 1.

However, sequences using chlorine dioxide are still favoured and they are feasible as for environmental aspects also. There are many reasons for that. In comparison with other chemicals, the price for chlorine dioxide is very competitive; it is today approx. half of the price for, e.g., competing hydrogen peroxide or its various derivatives. Moreover, the strength and brightness values of the pulp obtained by dioxide bleaching are high. In fact, they are at least of the same standard as the values obtained by using peroxide, with the same chemical consumption (kg/adt).

An object of the invention is to apply, in an economical. and pro-environmental manner, at least one chlorine dioxide stage (D) to a bleaching sequence, which uses modern bleaching chemicals such as ozone (Z) or peroxide (P), in other words, hydrogen peroxide or some other chemical behaving like a hydrogen peroxide in bleaching. Instead of using chlorine dioxide as the main bleaching chemical as it has been used earlier, its role has been changed in our invention. Here it is in the first place used as an additional or auxiliary chemical for activating and subjecting pulp to the influence of the main chemical. In this case, when chlorine dioxide is used together with peroxide and ozone in accordance with the present invention, the AOX number of chlorine dioxide may be even less than 0.5. Furthermore, the filtrates from the chlorine dioxide stage may be treated together with the filtrates from the chelating stage in a separate evaporating unit, so chlorine discharges as such are prevented from escaping from the dioxide stage to effluents. This procedure already prevents chlorine compounds from ending up in the mill effluents.

The amount of chlorine dioxide (D) actually used, e.g., in sequences ZD-EOP-ZD-D or ZD-EOP-DQ-$P_O$ remains very low in our invention. Chlorine dioxide is primarily used as an additional chemical in ozone bleaching (Z) and peroxide bleaching (P), to improve the process economy and pulp quality. A chlorine dioxide dosage may be even as low as 1 to 30 kg chlorine dioxide calculated as active chlorine per pulp ton. Normally, the need may be 10 to 20 kg chlorine dioxide per pulp ton. In combined stages DQ and ZQ (Q denotes metal removal in general) use of peroxide is decreased because metal removal done with, e.g., these stages, prior to peroxide is highly efficient. ZD as well as DZ reduces use of chlorine dioxide because each kilogram of ozone decreases the need for use of chlorine dioxide by 1–4 kg/adt. EOP is an alkali stage where a peroxide dosage is 0 to 10 kg/adt and $P_O$ is a peroxide stage where the peroxide dosage is 5 to 40 kg/adt. Both stages also use oxygen, and the dosage is 0 to 15 kg/adt, preferably 3 to 8 kg/adt.

Use of combined stages ZQ and ZD is disclosed, e.g., in A. AHLSTROM CORPORATION's U.S. patent application No. 380,486. Both DQ and AQ are disclosed in A. AHLSTROM CORPORATION's patent applications FI 950749, FI 953343, and SE 9502078. DQ and AQ stages are advantageous prior to the peroxide stage.

Chlorine dioxide bleaching (D) is a well-known and widely used bleaching method. In conventional chlorine dioxide bleaching, the temperature is usually 70 to 90°C. and the dosage of chlorine dioxide is approx. 10 to 30 kg per pulp ton. Sequences used are, for example, $D_0ED_1ED_2$ and $OD_0ED_1ED_2$ and various modifications of these. The treatment time in the $D_0$ stage is normally shorter than in other D stages; it is, for example, 30 to 90 minutes. The pH of pulp lowers to a range of 1 to 3 at the end of the $D_0$ stage. In the $D_1$ and $D_2$ stages, the treatment time is 2 to 3 h and the pH is slightly higher than in the $D_0$. Earlier, it was common for the pulp entering the first stage $D_0$ that it contained plenty of lignin, which was quickly removed at the beginning of bleaching. Elemental chlorine was, and still is, generally used as an additional chemical in the $D_0$ stage for removing lignin. The conditions in the $D_0$ stage had been optimized for lignin removal.

When switching over to pro-environmental cooking and bleaching techniques, an object is to have a kappa number of pulp which is below 20, preferably below 12, with efficient cooking and subsequent oxygen delignification. After efficient cooking and oxygen delignification, use of earlier known $D_0$ stages has continued by force of habit in prior art installations, as it has been assumed that the pulp still contains relatively much lignin. However, this is not wise, as explained in the following. Namely, it has been established that when the kappa number is this low, the pulp no longer contains much lignin. In other words, the kappa number is not so much dependent on lignin but mainly on carbohydrate compounds, for example, different acids. For removal of these, there are better and more efficient ways than the conventional $D_0$ stage.

The conventional $D_0$ stage is not optimal if the intention is to remove something else than lignin.

A prior art method of decreasing the kappa number of pulp by 1–9 units is to treat the pulp with acid (A). At A stages, the pH is within the range 1 to 6, preferably 2 to 5, and most preferably 3 to 4 when the explicit intention is to decrease the kappa number. The intention of these treatments is, e.g, to decrease the kappa number of pulp prior to actual bleaching stages. By raising the temperature, it is possible to accelerate the lignin removal reaction. An advantageous temperature is 80 to 140° C., most preferably 90 to 110° C. The most suitable temperature has often been considered to be 90 to 100° C., at which temperature a reaction time of 60 to 180 minutes, preferably 60 to 120 minutes, provides the decrease in the kappa number which is obtainable in the first place with acid and/or chelation treatment. The kappa number of hardwood decreases more than that of softwood.

Normally, the kappa number of softwood decreases by 1–3 units and the kappa number of hardwood by 3 to 6 units in an acid treatment.

An object of the present invention is to disclose how the D stage, especially the $D_0$ stage, may be intensified by maintaining in the D stage conditions which are favourable to the kappa number reduction, and chlorine dioxide consumption be simultaneously decreased.

The chlorine dioxide stage is usually run at a temperature of approx. 70° C., the treatment time at the $D_0$ stage being 0.5 to 2 hours and at the $D_1$ and $D_2$ stages 2 to 3 h. It has been tried to avoid higher temperatures because a low final pH of 1 to 3 at the D stage, when combined with a high temperature and a long treatment time, damages the strength properties of fibers. It is, however, possible to raise the temperature and extend the duration of the D stage, especially of the $D_0$ stage if it is seen to that the pH is maintained over 2, preferably over 3. The chemical reactions reducing the kappa number of the A or Q stage may be effected at the D stage by seeing to that, during the D stage the pH is within the range of 2 to 5, preferably 3 to 4, and the temperature within the range of 80 to 130° C., preferably 90 to 110° C. Part of the treatment time of the D stage the pH may be something else, and naturally this is the case, too, because reacting of chlorine dioxide produces acids. It is, however, essential the treatment time in the pH range of 2 to 5, preferably 3 to 4, is long enough, i.e., over 40 minutes, but preferably longer, usually over 60 minutes. It is also essential that the pH is not below 2 for too long a time since this damages fibers, as was stated above. It is also essential that the method is applied to a pulp in which the kappa number has been decreased to a value below 20, preferably below 12, by cooking and delignification, so that also other matter than lignin may be removed at the dioxide stage.

Another object of the invention is to provide an apparatus for meeting the technical requirements of the method. In other words, such an apparatus has neither been used nor even existed by which pulp could have been heated or cooled to a desired temperature and through which pulp could have been fed to a treatment tower at the same time equalizing the pulp temperature. This object of the invention is achieved by an apparatus which comprises an indirect heat exchanger, mixing/feed means, and a treatment tower.

A still another object of the invention is, on the one hand, to strive for decreasing the energy consumption of the mill, and on the other hand, to make it possible to connect treatments done at various temperatures in an economical manner one after another in order to form a bleaching sequence. For example, use of chlorine dioxide together with, e.g, peroxide, the latter being very popular today, is problematic because bleaching with chlorine dioxide usually takes place at a slightly lower temperature than bleaching at the efficient peroxide stage. In other words, for the chlorine dioxide stage subsequent to the peroxide stage, pulp should be cooled to some extent and, correspondingly, for the peroxide stage subsequent to the chlorine dioxide stage it should be heated. If a well-known prior art way of heating, i.e., direct steam heating were used, there would be a considerable increase in the steam consumption of the mill, which would also add to the costs remarkably.

The same problem can be seen also in sequences using ozone because ozone is most usually used at a temperature of approx. 50 to 80° C., but higher temperatures (80 to 110° C.) are also possible.

It is previously known to use high-pressure steam for the above-mentioned purposes, i.e., for heating pulp for bleaching, by which high-pressure steam pulp is heated directly. The equipment according to prior art is comprised of a so-called MC pump, which feeds pulp to the bleaching stage (the process most usually takes place at a consistency of 10 to 15%, which is a so-called medium consistency or an MC range), steam feeding means, mixer, reaction tower, means discharging pulp from the tower, blow tank where pulp is passed from the tower, pulp discharge pump, and condenser for discharged steam. As the above list of equipment implies, the bleaching process advances as follows: the pulp is fed by a pump to the steam feeding means, where the pulp temperature is raised to a desired level by feeding high-pressure steam directly into the pulp. After adding the steam, the pulp is conveyed to the mixer, which, besides equalizing potential temperature differences brought about the addition of steam, also mixes a desired bleaching chemical/bleaching chemicals or other treatment chemicals, such as chelating agent, acid, or alkali with the pulp. From the mixer, the pulp is further conveyed to the reaction tower, where the bleaching/treatment reaction itself is allowed to take place. For example, in peroxide bleaching, the temperature in the tower is maintained at approx. 100° C.; even 130° C. temperatures have sometimes been suggested, and the pressure in the lower part of the tower is approx. 10 to 8 bar and in the upper part thereof approx. 5 to 3 bar. The pulp is discharged from the tower by the discharge means to the blow tank, where the steam still present in the pulp is separated therefrom into the upper part of the blow tank. From the blow tank the pulp is discharged by the discharge pump. The steam separated to the upper part of the blow tank is further conveyed to the condenser, where the heat still present in the steam is recovered, thereby generating condensation water.

The process described hereinabove, however, involves some drawbacks:

Firstly, a great portion of steam is condensed in the pulp, so the pulp consistency is no longer the same it was when the pulp left the pump.

Secondly, the pulp pressure in the steam feeding means has to be limited to approx. 9–10 bar because there is no steam available which would be at a higher pressure.

Thereby, also the process pressure in the reaction tower is limited to the above-mentioned value.

Thirdly, for recovering heat and conveying pulp to the next process stage, a large combination including a blow tank, pump, and condenser, is needed.

Fourthly, the highest temperature of the condenser is 100° C. because the pressure is lowered to the same level as the outside air pressure.

Fifthly, the condensation water from the condenser is dirty because it contains residues from both bleaching chemicals and bleaching reaction products.

Besides solving the above-mentioned problems involved in direct heat exchange in a very elegant manner, the present invention also makes some bleaching sequences which are already very practicable and efficient and which use chlorine dioxide, chelation, acid treatment, peroxide peracetic acid and/or ozone or various combinations of these, still more attractive.

A characterizing feature of the method in accordance with a preferred embodiment of the invention is that the chlorine dioxide stage according to the invention is the first chlorine dioxide stage of the bleaching sequence, i.e., a so-called $D_0$ stage. A suitable chlorine dioxide dosage for this kind of stage is 1 to 40 kg chlorine dioxide calculated as active chlorine per pulp ton. Preferably, the dosage is 5 to 30 kg, and most preferably 5 to 20 kg per pulp ton.

It is a characterizing feature of a second preferred embodiment of the invention that the pulp is cooked and, if necessary, oxygen delignified-to a kappa number of under 20, preferably under 12;

the pulp is bleached in a chlorine dioxide stage the temperature of which is 90 to 110° C., preferably 95 to 100° C., so that the pH is within the range of 2 to 5, preferably 3 to 4, for over 40 minutes, preferably 60 to 120 minutes while the chlorine dioxide dosage is over 5 kg active chlorine per pulp ton.

In accordance with a third preferred embodiment, a chlorine dioxide solution is preheated with heat transfer surfaces, which are preferably made of titanium and disposed in either the bleaching tower or the outlet duct for pulp.

It is a characterizing feature of the method in accordance with a fourth preferred embodiment of the invention that the pulp is fed with a high-consistency pump within a consistency range of 8 to 20% to an indirect heating means which is provided with heat transfer surfaces, after the heat exchanger, the pulp is conveyed to a mixing device, which is preferably fluidizing, and this mixing device or a device preceding thereof is supplied with bleaching chemical, which is preferably chlorine dioxide, the pulp is transferred to a bleaching tower, which is preferably pressurized, the pressure being 0.1 to 15 bar overpressure, in which tower the pulp is bleached, the treatment time being 40 to 180 minutes, and the pulp is discharged from the tower preferably with a fluidizing discharge means, which may be supplied with additional chemicals.

Other characterizing features of the method and the apparatus according to the invention will become apparent from the enclosed claims.

Laboratory tests indicate that in bleaching of softwood pulp with chlorine dioxide, the need for chlorine dioxide in a $D_0$ stage according to the above described invention is over 10% less than in a conventional $D_0$ stage. With hardwood pulp, the difference is still more significant. In other words, the need for chlorine dioxide with hardwood in the $D_0$ stage of the invention is over 25% less than in a conventional $D_0$ stage. The difference is caused by the fact that when bleaching with chlorine dioxide is effected at too low a temperature or at an unsuitable pH value, the only bleaching reactions are reactions of chlorine dioxide. When the pH value is correct, preferably 3 to 5, and the temperature sufficiently high, i.e., 80 to 110° C., hot and acid conditions alone perform part of the bleaching.

DETAILED DESCRIPTION OF THE DRAWINGS

Figure 1:
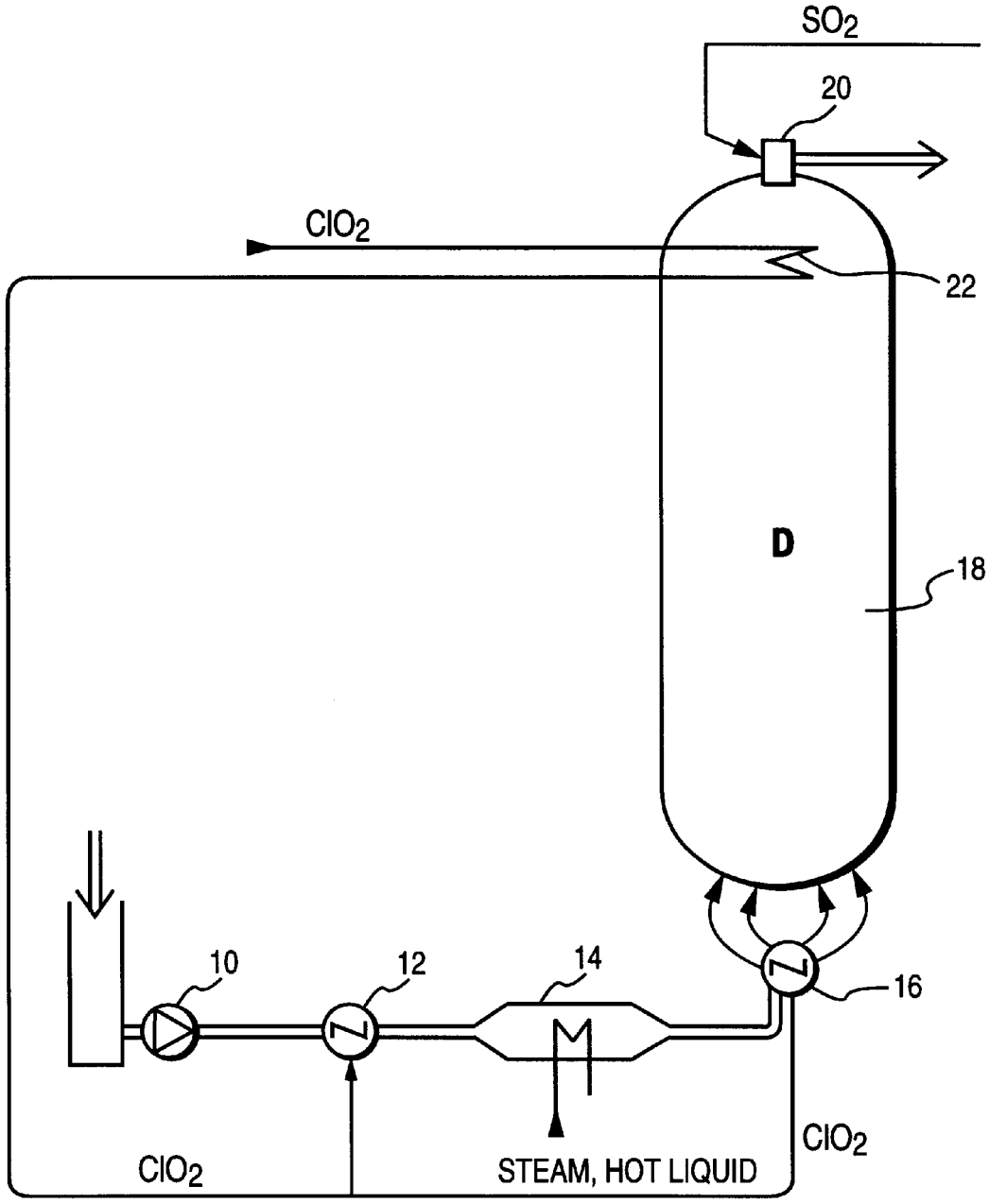
FIG. 1 shows a bleaching tower arrangement in accordance with a preferred embodiment of the invention.

FIG. 1 shows a bleaching tower arrangement suitable for the methods described above in outline. The pulp is pumped with a high-consistency pump 10 in a consistency of 8 to 20% from the preceding treatment stage/treatment means, e.g., from a washer or a press to a chemical mixer 12 (preferably AHLMIX™ mixer sold by A. AHLSTROM CORPORATION), in which chlorine dioxide and/or potential other chemicals, such as oxygen, peroxide, peracetic acid, alkali, etc. are added to the pulp. Thereafter, the pulp is transferred to an indirect heat exchanger 14, where pulp is heated with heat transfer surfaces disclosed, e.g., in A. AHLSTROM CORPORATION's patent application FI 943001 or co-pending WO application PCT/FI96/00330, by utilizing either steam, preferably low-pressure steam, or hot liquid. These heat transfer surfaces may also be fins disposed in the pulp inlet duct, the diameter of which may be, e.g., 0.5 to 2 m, the fins having a length of preferably 0.2 to 2 m and extending either partly or totally across the duct. It is advantageous to coat the fins and the heat transfer surfaces if there is peroxide present, for preventing peroxide from dissolving. Otherwise, it is advantageous to use such metal or other material which stands prevailing chemical conditions. Next, the pulp flows to a mixing device 16, where temperature differences are equalized between different layers of pulp. This device 16 is preferably a so-called distributing feed means, which is disclosed in A. AHLSTROM CORPORATION's Finnish patent application 924805. $ClO_2$ and/or other chemicals may be added through device 16 (if its mixing properties are effective enough), and thereby it even possible to avoid use/purchase of device 12. From device 16, the pulp flows to a reaction tank 18, which is designed for a treatment time of 40 to 180 minutes. When using a distributing feed means in accordance with the above-mentioned Finnish patent application, it may be secured that the tower is filled evenly throughout and that the pulp column in the tower grows uniformly upwards so that no harmful channelling is brought about. Naturally, it is possible to effect chemical mixing also in the heat exchanger 14 itself if it is provided with a mixer for equalizing temperature differences.

Reaction tank 18 is preferably pressurized so that the pressure at the top of the tower is 0.1 to 15 bar, preferably 0.1 to 3 bar, overpressure. The purpose of the pressure is to prevent boiling, intensify the bleaching process and/or to facilitate transfer of pulp forward. At the top of the tower is disposed a discharge means 20, wherethrough preferably sulphur dioxide or equivalent chemical is added, for removing residual chemicals from the pulp. In accordance with a preferred embodiment, the chlorine dioxide solution is preheated with heat transfer surfaces 22, which are disposed in the bleaching tower 18 and are preferably made of titanium. Heat transfer surfaces 22 may also be disposed in the outlet duct after discharge means 20, in the same way as the heat exchanger 14 described above, and not in the tower itself. Preferably these surfaces are composed of fins described above. In this way, heat transfer surfaces disturbing the flow need not be used in the tower. Thus, it is a characterizing feature of the bleaching method now invented that the pulp is heated in the inlet duct of the tower with an indirect heat exchanger disposed prior to a mixing device, for equalizing temperatures prior to the bleaching reaction and that the pulp is cooled with a heat exchanger disposed in the outlet duct of the tower, which heat exchanger need not necessarily be disposed prior to the mixing device because the equalizing of temperatures is not inevitable after the bleaching reactions have taken place. It is also a characterizing feature of the invention that in the embodiment shown in the Figure, a liquid to be fed to some stage of the process, which liquid is chlorine. dioxide solution in this Figure, is heated indirectly with heat recovered from the pulp. Inversely, it can also be established that the pulp which is discharged from the reaction tower is cooled by liquid to be fed to some stage of the process.

Heat exchanger 14 illustrated in FIG. 1 is indirect and usually made from metal. On the side of the heat transfer surface which side is opposite to pulp there is usually heating liquid or steam. Most usually, heating is effected with steam, preferably low-pressure steam, and cooling with cold liquid. Other heat transfer mediums may be various process liquids which have to be cooled or heated, such as, for example,a filtrate from the washer or press, or some liquor to be fed to the digester. Medium-consistent pulp (having a consistency of 5 to 20%, preferably 8 to 16%) flows as a plug flow through the heat exchanger, the average flow rate being below 5 m/s, preferably 0.1 to 1.0 m/s. The heat exchanger is so constructed that each portion of the pulp is heated/cooled for only a relatively short time, i.e., less than 10 s, usually less than 1 s, most usually less than 0.5 seconds, whereafter a new portion of pulp plug flow will contact some of the heat transfer surfaces of the heat exchanger. In this way, various portions of the pulp flow are heated/cooled and the temperature differences in various parts of the plug flow are then equalized with device 16, which is a mixing or a fluidizing device. In the heat exchanger, the pulp temperature is raised or lowered by over 5° C., preferably over 10° C., most preferably by 10 to 30° C.

Figure 2:
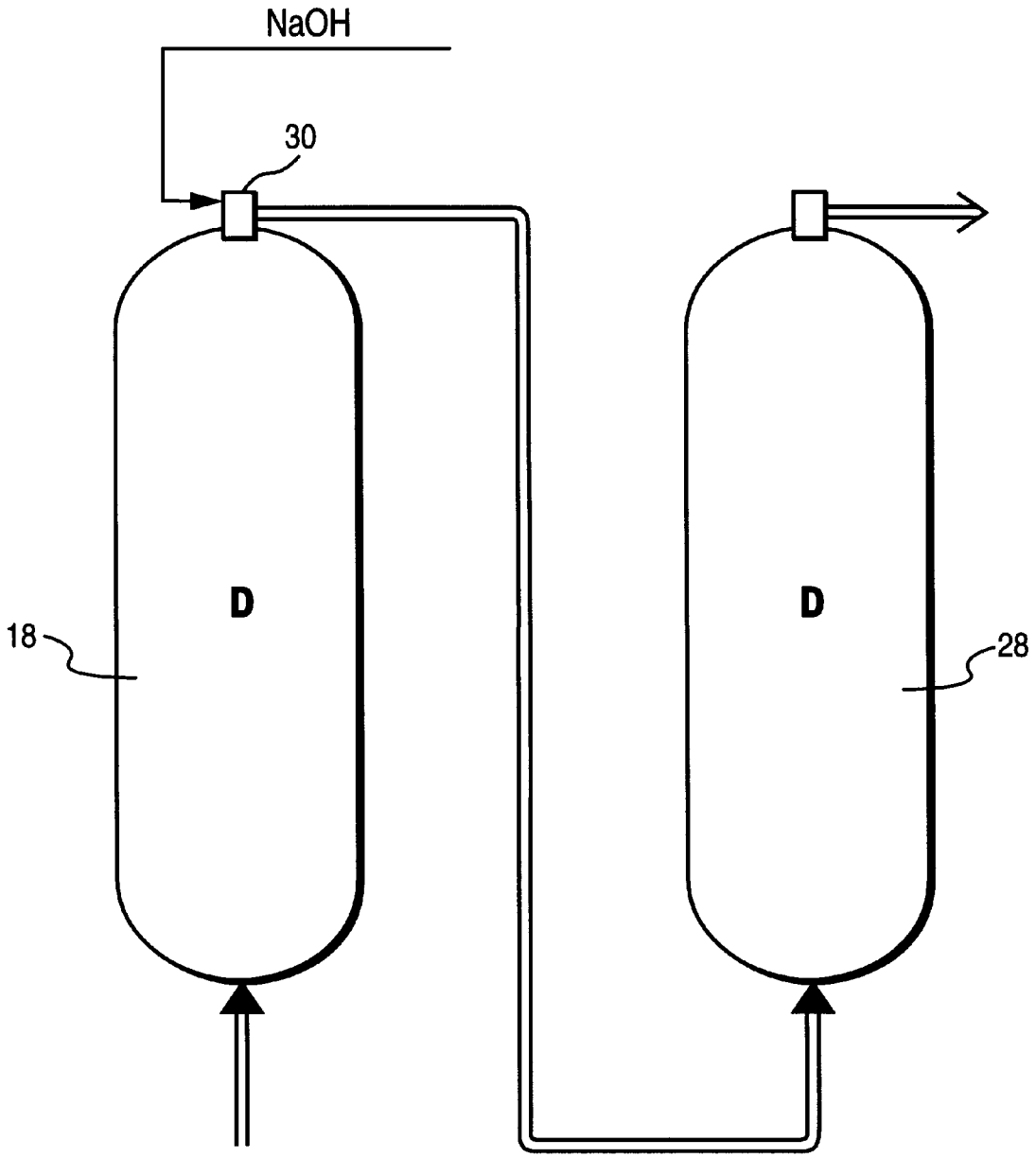
FIG. 2 shows a bleaching tower arrangement in accordance with a second preferred embodiment of the invention.

FIG. 2 shows a bleaching tower arrangement in accordance with a second preferred embodiment of the invention. When compared with FIG. 1, the arrangement of FIG. 2 is provided with a second chlorine dioxide bleaching tower 28. At the beginning of chlorine dioxide bleaching, the pH may be within the range of 7 to 5 and, while chlorine dioxide is being consumed, the pH lowers to a level of 2 or even below that. An optimal pH range may be maintained for a longer period, by adding alkali (NaOH) while the reaction is taking place. Preferably this is done by sharing the bleaching reaction among two towers, i.e., 18 and 28, and by feeding alkali through a discharger 30 of the first tower. For that reason, the discharger is preferably fluidizing, whereby sufficiently effective mixing of chemical may be secured. The retention time chosen for the first tower 18 is, e.g., 20 to 90 minutes. The pressure at the top of the first tower is maintained at 5 to 15 bar, so that is high enough for transferring the pulp to the second tower 28. Thereby, it is evident that use of two treatment stages, i.e., towers, is possible in connection with FIG. 1, and in one-stage dioxide stages and other bleaching stages which will be described later in this application.

Figure 3:
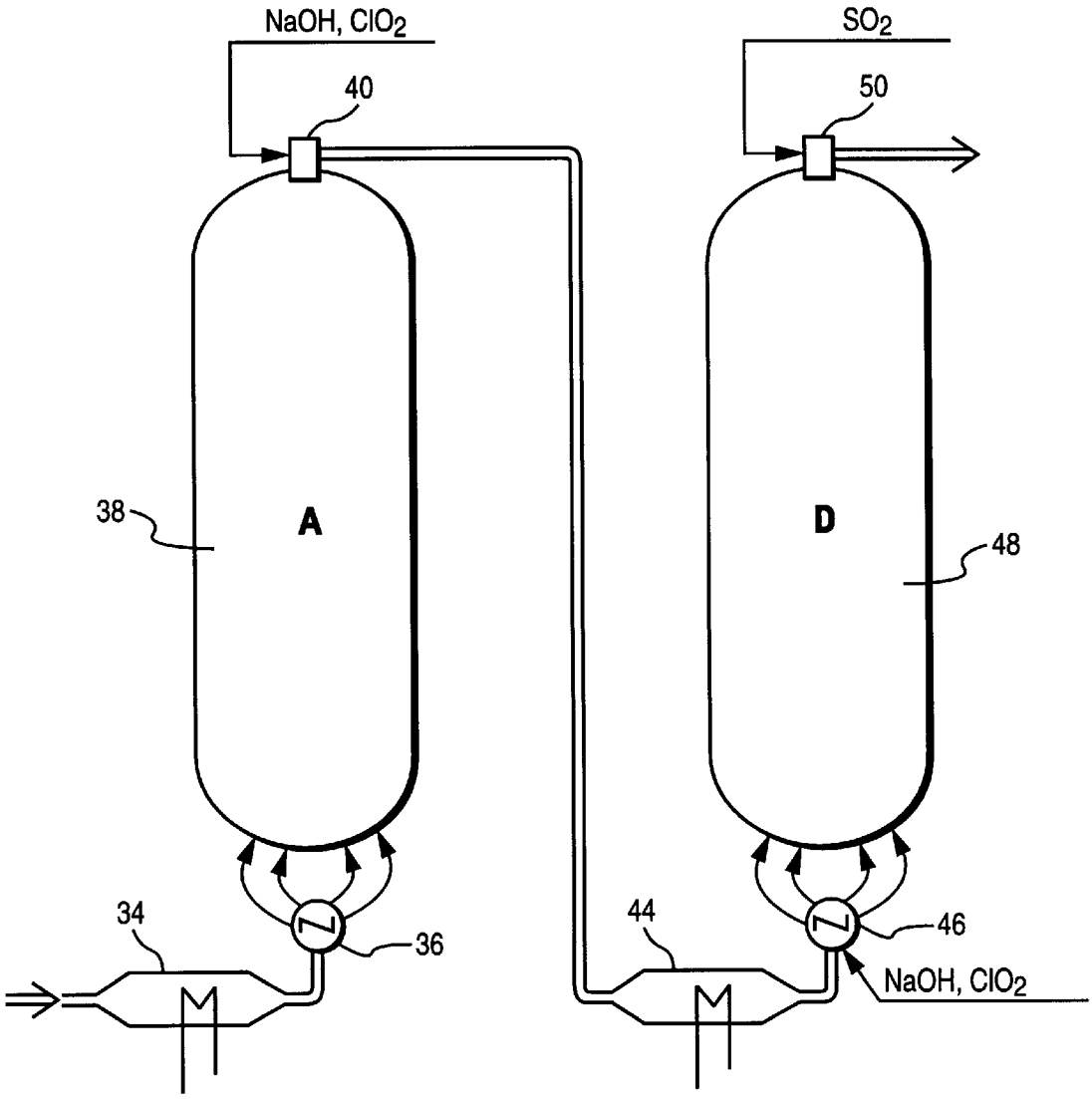
FIG. 3 shows a bleaching tower arrangement in accordance with a third preferred embodiment of the invention.

In accordance with still another preferred embodiment of the invention, shown in FIG. 3, the D stage effected in a tower 48 may be preceded by an acid treatment or an A stage effected in a tower 38. This A stage may also be called an acid stage. It is purposed for improving the bleachability of pulp. Typically, it is effected in the following process conditions:

consistency 8 to 20% temperature 80 to 110° C.

pH 3 to 5, and duration 30 to 180 min, whereby the kappa number of pulp in said A stage decreases by 1–6 units.

It has been established in laboratory tests that the decrease of kappa number is 1 to 3 units with softwood pulp and 2 to 6 units with hardwood pulp. Both types of pulp have been cooked and, thereafter, oxygen-delignified so that the kappa number has been below 18, preferably below 12. On-the basis of these tests, it has been established that the A stage is especially advantageous for pulp which has been pretreated in this manner.

In this case, pulp is preferably heated prior to the A stage by a heat exchanger 34 and cooled prior to the D stage with a heat exchanger 44. This is especially advantageous when pulp is susceptible to the temperature and when we do not want to maintain unsuitable temperatures. As further implied by the Figure, alkali (NaOH) and/or chlorine dioxide may be added via a discharger 40 of acid tower 38 and/or via a feeding means 46, preferably distributing, of dioxide tower 48. Sulphur dioxide may naturally be introduced via a discharger 50 of the dioxide tower into pulp.

The tower combination AD effects the same reactions as the tower combinations DD, but in such a manner that the first to take place are the acid reactions in tower A and then the chlorine dioxide reactions in tower D. The second stage of AD is the D stage, in which the process conditions are typically as follows:

consistency 8 to 20% temperature 70 to 100° C. (or higher)

initial pH 6 to 9 end pH 3 to 5 duration 60 to 180 min chlorine dioxide dosage 5 to 30 kg $ClO_2$/adt, and chemicals, such as Mg, Ca, EDTA, DTPA, etc., which adjust the metal profile, are applicable.

In the tower combination DD, the reactions take place in both towers so that the A reactions take place in those parts of the D towers in which the temperature and pH are correct. In view of pulp transfer, it is advantageous to maintain at least the first tower at a pressurized state. It is, however, evident that the towers in FIGS. 2 and 3 may be unpressurized, whereby the pulp has to be transferred forwards with a pump.

The reactors shown in FIGS. 2 and 3 may be used also in connection with the A stage. pH adjustment between the towers makes it easier to regulate the pH to a range of 2 to 5, preferably 3 to 4. This arrangement is especially advantageous when the pH of pulp changes as a result of reactions. This may be due to, e.g., feeding of some additional chemical, such as, e.g., enzyme. Thus, the tower combinations DD and AD change to a tower combination AA, which facilitates regulation of both pH and temperature during a reaction.

As an example of use of the tower combinations shown in FIGS. 2 and 3, it can be established that the same equipment, in fact, enables AA, DA, AD, DD run, even so that the temperatures are freely adjustable. In other words, the plant has been built for DD, i.e., a two-stage chlorine dioxide bleaching, but it is possible to implement a two-stage AD, in which the D stage may be even the conventional D stage in which the temperature is 60 to 80° C. The tower arrangement in accordance with FIG. 3 may be further developed by dividing the acid stage A into two towers, as shown more in detail in FIG. 2. In other words, the acid stage becomes a two-stage AA, whereby it is possible to add acid or alkali between the towers, for adjusting the pH to a desired value.

The above-described method according to the invention is applicable to chlorine dioxide sequences having 1 to 5 stages, i.e., sequences including one or more bleaching stages or phases using chlorine dioxide. Suitable sequences are, e.g., D-E-$D_E$-D and D-E-D. Sequences may also be so developed that they change to a form which has a two-stage constituent, i.e., DD-E-D or AD-E-D, whereby one dioxide stage can be left out. Suitable sequences are also those in which peroxide is used. For example, DQ-P or $D_E$-DQ-P or $D_E$-D-P, in which the first D stage is preferably DD or AD. Interesting sequences are also cooking-O-ADQ-P and cooking-O-DDQ-P. Other suitable sequences are disclosed, e.g., in A. AHLSTROM CORPORATION's Finnish patent applications Nos. 950749, 953064, and 953074. The method is applied, as stated above, preferably to the first chlorine dioxide stage, but in some special cases also other places in the sequence are, in some special cases, feasible. An interesting way of using the tower combination DD prior to peroxide bleaching is to effect treatment $DD_Q$-P, where $D_Q$ is a chlorine dioxide tower and where the conditions are selected so that they will be suitable for metal removal. Thus, the conditions in the first tower are optimized in view of bleaching and those in the second tower, i.e., $D_Q$ tower, in view of metal removal. This may mean use of a suitable pH range and suitable additional chemicals. A suitable pH is of the order of 5 to 9 and suitable additional chemicals are some complexing agents standing chlorine dioxide, and some metals, such as Mg and Ca.

When the D stage in accordance with the invention is used in the bleaching sequence together with a bleaching stage which uses peroxide, it is advantageous to remove heavy metals, such as, e.g., iron, copper, and manganese, and to adjust the metal profile prior to the peroxide stage or an alkali extracting stage, in which peroxide has been added. The metal profile is adjusted with either adding chelating agents and metals, such as magnesium and/or calcium, to the D stage. Another mode is to combine the D stage to the Q stage, e.g., as disclosed in A. AHLSTROM CORPORATION's patent application FI 953064, for building up a DQ phase. Furthermore, it is possible to use a combination of these modes. It is also possible to replace Q with mere acid stage (A) and to operate without chelating agents, with a two-stage combination DA. Stage D alone, whereto metals are added, such as magnesium and/or calcium but not chelating agents (Q), is also feasible.

The apparatus described above has a considerably wider range of use than the method described above. The combination of equipment described, i.e., indirect heat exchanger—mixer—tower, or, tower—indirect heat exchanger—mixer—tower are applicable, besides when chlorine dioxide is used, also when oxygen, peroxide, peracetic acid, and acid treatment or treatment with some other chemical is used. It is typical that the temperature is raised or lowered by over 5° C., preferably over 10° C., most preferably 10–30° C., in a heat exchanger. It is typical to two-tower arrangements, i.e., two-stage treatments that a temperature difference of over 5° C., preferably over 10° C., is maintained between the bleaching towers. Naturally, it is evident that said apparatus is also applicable to treatments with several stages, for example, to OO, PP, and AD and the like. In other words, the apparatus according to the invention, having either a single stage or a plurality thereof, is well applicable to, e.g., implementing hot peroxide bleaching, which has become popular lately. In this case, the pulp temperature may be raised by a heat exchanger to a higher value than what has earlier been considered a practical limit, i.e., to a value over 90° C., even over 100° C.

It has to be noted that the A and D stages, both those described above and those to be discussed below, may be effected in reverse order, i.e., all AD phases or AD partial phases may be performed in order DA.

Sequences applying the AD phase may be, e.g., the following:

O-AD-E-D, and O-AD-E-$D_E$-D and O-AD-$P_O$. The oxygen delignification stage O may, however, be left out when the kappa number of the pulp coming from the cooking stage is sufficiently low.

Figure 4:
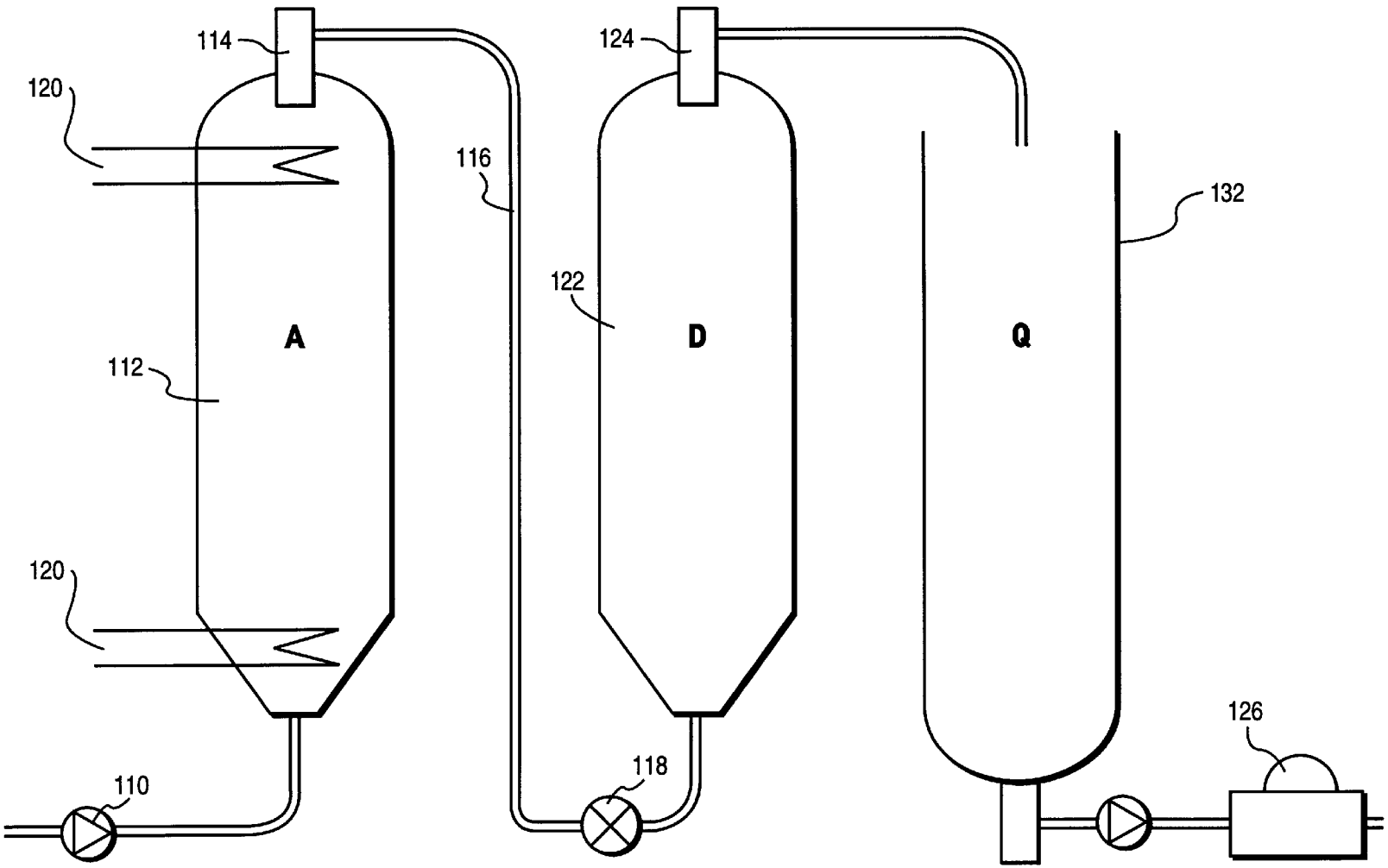
FIG. 4 shows a bleaching tower arrangement in accordance with a fourth preferred embodiment of the invention.

According to a second preferred embodiment of the invention, use of chlorine dioxide may also be combined with the sequence in which peroxide and a preceding chelation treatment are used. As known, chelation (Q) means treating of pulp with so-called chelating (e.g., EDTA, DTPA, or equivalent), in which case the intention is to remove heavy metals from the pulp, such as iron, copper, and manganese so that they cannot degrade peroxide. Suitable conditions for chelation are as follows: pH 4 to 6, duration 10 to 60 minutes, and temperature 60 to 100° C. When peroxide stage P is used, the pulp is preferably first treated in tower combination DQ (in two stages) or possibly ADQ (in three stages), for removing heavy metals, as shown in FIG. 4. FIG. 4 illustrates three successive towers 112, 122, and 132. The first of them is an acid treatment tower 112, which is taken into use only when needed, as mentioned earlier. In connection with tower 112, it is disclosed how pulp can be heated or alternatively cooled at both ends of the tower, by means of heat exchangers 120. Heat exchangers need naturally be arranged at one end of the tower only, if the temperature of the pulp entering the tower or being discharged therefrom is suitable for the subsequent treatment. It is also evident that the heat exchanger may be arranged in the inlet duct of the tower or correspondingly in the outlet duct thereof. From the second tower 122, pulp is preferably discharged to an open chelation tower 132, and after the pulp has been treated therein, heavy metals are washed of f of the pulp in a washer 126. Also other towers 122 and 132, or their inlet and/or outlet ducts may be provided with heat transfer surfaces 120, whereby the temperature in different towers may be selected according to need, without any direct use of high pressure steam.

Use of sequences O-DQ-$P_O$ or O-ADQ-$P_O$ effected by the described tower system gives quite high brightness values. On the basis of laboratory tests performed, brightness values obtainable with said sequences are over 85 ISO. Brightness may be further increased by adding D, Z, or $P_O$ stages.

Longer sequences which give a higher brightness are thereby, e.g., O-D-E-DQ-$P_O$ or O-DQ-$P_O$-DQ-$P_O$. Mg, Ca, and other metals or chemicals may be added to the dioxide stage, to balance the metal profile. In this way, two-stage DQ may possibly be replaced with mere D, which has been supplied with one or more chemicals, for example, Mg, Ca, EDTA, DTPA. Thus, DQ may refer to an intensified D stage with respect to metal treatment. It is also advantageous to combine the A treatment with D stages in these sequences so that a single-stage D is replaced with a two-stage AD and the two-stage DQ with a three-stage ADQ.

The peroxide stages P are, as described in the above exemplary sequences, preferably oxygen reinforced peroxide stages $P_O$. It has to be remembered, however, that also pure peroxide stages P are applicable. The peroxide dosage is normally 5 to 25 kg $H_2O_2$/adt and the oxygen dosage 0 to 10 $O_2$/adt. In both mere peroxide stages P and oxygen-reinformed peroxide stages $P_O$ it is advantageous to use an arrangement comprising two towers with gas separation therebetween in a manner disclosed in A. AHLSTROM CORPORATION'S Finnish patent application 934056, which refers to a so-called P/P stage, which naturally covers alternatives P/P, P/$P_O$, $P_O$/$P_O$ and $P_O$/P. When peroxide is used, advantageous TCF sequences are O-AQ-$P_{a\text{-}PO}$ or O-Q-$AP_a$-$P_O$, in which $P_O$ is preferably the above-described arrangement with two towers and in which $P_a$ may also be $P_a$Q.

The sequence according to a third preferred embodiment of the invention uses, besides chlorine dioxide D also ozone Z. The sequences described next may, in principle, be effected using similar tower constructions as the sequences described above. In other words, by connecting several towers, in which the treatment temperatures vary, one after another. The treatment may be effected, e.g., by using sequence AQ-$ZP_O$ or AQ-ZQ-$P_O$. When there are heat exchangers arranged in connection of the towers, or in their inlet and/or outlet ducts, the temperature of the treatment is readily adjustable. A previously known sequence A-ZQ-$P_O$ is easy to convert so as to make it slightly more practicable. An still further interesting sequence is AQ-ZP-ZP. An advantage of this sequence is an open AQ phase prior to Z, which lessens concentration of solids from the oxygen (O) and Q stages to the first Z stage. This kind of concentration would increase the consumption of ozone by 1–2 kg/BDMT.

By building up a sequence AZQ-$ZP_O$-$ZP_O$ and by providing the towers or their inlet and/or outlet ducts with indirect heat exchange, we would have many potential modes of running. Ozone dosage may, e.g., be left out from one or more ozone stages, thereby converting the sequence into another one.

A still further preferred embodiment of the method of the invention, which is worth mentioning, is a four-stage sequence A-$P_O$-AZQ-$P_O$ which uses ozone. It could also be AQ-$P_O$-AZQ-$ZP_O$. The second ozone stage Z lessens the fast initial consumption of peroxide. The overall result is somewhat better than with the first-mentioned sequence. The sequences AZQ-$P_O$-AZQ-$P_O$ and AQ-AZQ-$P_O$-$ZP_O$ are also possible. In other words, also four-stage sequences have need for two towers, in which the temperature is changed between the towers. In the above-mentioned sequences $ZP_O$ may as well be $AZP_O$. Likewise, $P_O$ may be Op, in which case the oxygen dosage is 5 to 15 kg/adt, but the peroxide dosage usually less than 15 kg/adt.

Figure 5:
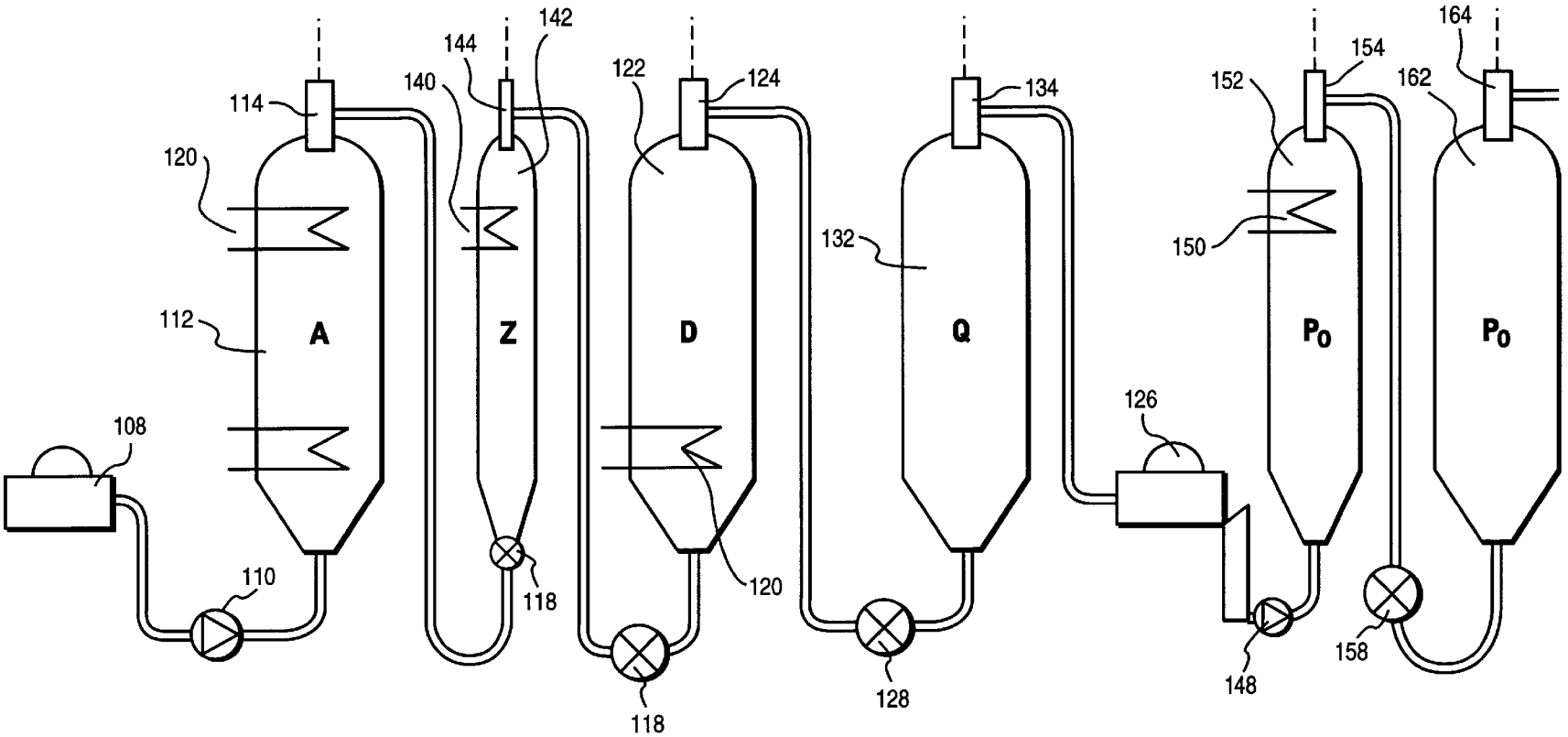
FIG. 5 shows a bleaching tower arrangement in accordance with a fifth preferred embodiment of the invention.

An interesting sequence is O-AZDQ-P (FIG. 5). It is possible to dispose a washer between the A and Z stages. In other words, the pulp is delignified (O) or preliminarily bleached, first with oxygen to a kappa number 8–14, and then it is washed with washer 108 or alternatively pressed, at two or three stages, whereafter bleaching phase AZDQ follows.

This bleaching stage comprises

Acid treatment (A) in 112 for acidifying the pulp and for lowering the pH value prior to the ozone stage. The acid used (sulphuric acid, hydrochloric acid, or some suitable organic acid) is mixed with the pulp, preferably in pump 110. A suitable pH value is 3 to 4 and temperature 80 to 110° C., preferably 90 to 110° C. The kappa number decreases by approx. 1–6 units. If the temperature of the pulp entering the tower 112 is either too high or too low, the tower or its inlet and/or outlet duct may be provided with heat transfer surfaces 120.

If needed, a washing stage.

The ozone treatment (Z) is effected by mixing ozone with pulp, 2 to 5 kg ozone per pulp ton, either in one or more mixers 118' and by allowing the ozone to react with the lignin of pulp in a reactor 142. This ozone treatment decreases the kappa number by 1–5 units while the treatment temperature is approx. 80° C. The temperature may be something else though, because the ozone stage is not dependent on the temperature. The Figure also shows how the upper section of ozone reactor 142 or its outlet duct may be provided with a heat transfer surface 140, for heating the pulp for the next treatment stage. In connection with the Z. stage, the effect may be improved by using 1 to 10 kg, preferably 1 to 5 kg peracetic acid. Peracetic acid is added prior to, in connection, or after the ozone stage.

The chlorine dioxide bleaching (D) is effected in tower 122, the dosage being 1 to 30 kg, preferably 10 to 20 kg, at a temperature of 80 to 120° C., preferably approx. 90° C. The chlorine dioxide is mixed with the pulp preferably in mixer 118. The Figure also shows how the tower 122 is provided with heat transfer surfaces 120 in order to heat the pulp entering the tower prior to actual treatment. An indirect heat exchanger arranged in connection with the inlet duct of the tower may naturally also serve as a heat exchanger, as in FIG. 1.

Q treatment for removing heavy metals is effected in tower 132'. A suitable pH is 3 to 7. As a chemical/chemicals is/are added EDTA, DTPA, Mg, and/or Ca to the Q stage, to the end of D stage, to the pipeline connecting D and Q stages, or to a mixer 128 arranged specifically for the purpose. Preferably, all towers are provided with a top discharge means as mentioned above, which removes gas and raises the pressure, whereby the pulp can be transferred also through a long tower combination, without a pump.

The process temperature is regulated between the stages in the manner described above, by means of heat exchangers disposed in treatment towers, or in their inlet and/or outlet ducts. A suitable place for a heat exchanger is in the upper section of the tower, just before the top discharge means. In this way, the pulp temperature is equalized by the mixing effect of the top discharge means.

Between. towers 112/A, 142/Z, 122/D and 132/Q, the pH is adjusted by adding acid (either sulphuric acid or some suitable organic acid) or alkali (preferably NaOH).

After Q stage in bleaching, the pulp is washed with washer 126 and/or pressed in 1 to 3 stages prior to the second bleaching stage, which is effected by peroxide. The peroxide stage (P) is preferably effected as a two-stage $P_O$/$P_O$ in a two-tower system, where the upper section of the first tower 152 or a transfer line subsequent thereto, is provided with a heating means 150 and the upper section of the second tower 162 or a transfer line subsequent thereto is provided with a cooling means 160. The pulp coming from washer 126 is pumped with a pump 148, in which preferably also peroxide (5 to 40 kg/adt, preferably 8 to 20 kg/adt) and oxygen (0 to 10 kg/adt, preferably 3 to 8 kg/adt) are fed into the pulp, to a tower 152 at a temperature of 80 to 100° C., preferably 90° C. In the upper section of tower 152 or a transfer line subsequent thereto, the pulp temperature is raised by heat exchanger 150 to a treatment temperature of the next tower 162, which is approx. 100 to 110° C. The pulp temperature may be equalized in either the top discharge means 154 while pulp is being discharged from the tower or, if the heat exchanger is in the transfer line, in a pulp mixer 158. Top discharge means 154 also separates gas, both gas generated in the reactions and unreacted residual gas, from the pulp so that the second tower 162 may be supplied, preferably via mixer 158, with fresh peroxide (0 to 10 kg/adt, preferably 0 to 5 kg/adt) and oxygen (0 to 10 kg/adt, preferably 0 to 5 kg/adt), whereby the share of pure gas in the pulp has been maximized. Prior to discharging the pulp from tower 162, heat is recovered therefrom by heat exchanger 160 so that the discharge temperature of pulp is preferably about 90° C. Corresponding cooling may be effected also in the transfer line after the tower. With a top discharge means 164, gas is removed from the pulp so that the pulp of $P_O/P_O$ entering the washer contains very little gas which would disturb the operation of the washer. Between $P_O$ towers 152 and 162, the pH is adjusted by adding alkali (preferably NaOH). The first of the peroxide stages described is preferably pressurized, the pressure being 2 to 10 bar, preferably 4 to 7 bar. The pressure of the second peroxide stage is only slightly over atmospheric, more precisely, only to the extent that the liquid contained in the suspension could not boil at a raised temperature (approximately 100 to 110° C.).

Example of a Laboratory Test

Pulp was cooked and oxygen-delignified to a kappa number 8.5 in a laboratory. Brightness after cooking and oxygen-delignification was 60.8% ISO. Pulp pretreated in this manner was then further treated as follows:

1st stage

| | |
|---|---|
| Z: | dosage 3.5 kg $O_3$/pulp ton<br>pH 3<br>temperature 50° C., whereby<br>kappa number after treatment 4.7<br>brightness after treatment 66.0% ISO |
| D: | dosage 15 kg $ClO_2$/pulp ton calculated as active chlorine<br>pH 3<br>temperature 75° C.<br>treatment time 180 minutes, whereby<br>kappa number after treatment 2.1<br>brightness after treatment 72.4% ISO |
| Q: | pH 5.5 by dosing NaOH according to need<br>3 kg DTPA/pulp ton<br>temperature 50° C., whereby<br>kappa number after treatment 2.3<br>brightness after treatment 72.0% ISO |

After $ZD_Q$ described above, pulp was washed and treated in a second stage.

2nd stage

| | |
|---|---|
| Po | 15 kg $H_2O_2$/pulp ton<br>5 kg $MgSO_4$/pulp ton<br>1 kg DTPA/pulp ton<br>temperature 95° C.<br>treatment time 120 min<br>oxygen atmosphere 5 bar, whereby<br>kappa number after treatment 1.0<br>brightness after treatment 87.0% ISO |

Thus, the sequence O-ZDQ-P gave a brightness value of 87% by using 15 kg $ClO_2$, only. By altering the ozone dosage or chlorine dioxide dosage, it is easy to exceed the 89% ISO brightness. A somewhat higher brightness value than the above described results was achieved by arranging an acid stage A before the ozone stage Z. The A stage was in the above test only a short acidifying operation, which took about 2 to 20 minutes. Hence, the A stag e need not necessarily always be a long, hot and delignifying treatment, but acidification only. This kind of treatment is especially advantageous and desirable when the benefit to be expected from the A stage, in view of delignification, is small.

Industrially, it may be useful to dispose said hot, long A stage between O and ZDQ or between O and AZDQ. Consequently, the sequences will be O-A-ZDQ-P and O-A-AZDQ-P, or O-A-ZADQ-P. In this way, a cleaner water phase is obtained in the Z stage, which lowers consumption of ozone. The place for Q stage may be changed, too, whereby the sequence will be O-AQ-ZD-P.

The above-described sequence and its modifications are really inexpensive, as for their investment and operating costs, because use of chlorine dioxide is small. The costs are low because the sequence only has two bleaching stages and because two washers, only, are needed in the bleach plant. When a separate A stage is used, the bleach plant naturally needs three washers. This may reasonable in terms of chemical economy. The environmental affects of the sequence are small because the Z tower and the $P_O/P_O$ stage minimize consumption of chlorine dioxide. Consumption of chlorine dioxide is practically so small that the bleach plant may be built as a totally closed construction, and still avoid too high an amount of chlorides from concentrating in the circulation of cooking chemicals. The above-described sequence, however, gives high brightness values of over 85, even over 89.

Other partial sequences which are applicable and in accordance with the invention are, e.g., ADZQ-P,
AZQ-EOP-ZD-EOP-D,
AZQ-EOP-ZD-$P_O$,
AZD-EOP-D-D,
AZQ-EOP-D-D,
AQ-EOP-ZD-D, and
AQ-EOP-ZD-$P_O$.

As can be seen from the above description, we have managed to develop a bleaching method and apparatus, which are environmentally much friendlier than the earlier ones. It has to be noted, however, that the arrangements and methods described and illustrated above are preferred examples, only, showing many different constructions and places of operation in accordance with the invention. Thus, they have, by no means, been intended to limit the scope of the invention from what has been disclosed in the accompanying claims.

What is claimed is:

1. A method of treating cellulose pulp having a consistency of between 5–20% using at least one bleaching reactor and an indirect heat exchanger, said method comprising the steps of:

(a) causing the cellulose pulp at a consistency of between 5–20% to flow as a plug flow at an average velocity of less than 1.0 meter per second through the indirect heat exchanger to change the pulp temperature more than 5 degrees C.; and (b) at least one of prior to and after step (a) causing the pulp to flow into the bleaching reactor so that a bleaching reaction takes place.

2. A method as recited in claim 1 wherein step (a) is practiced so as to change the temperature of the pulp more than 10 degrees C., and wherein the pulp in steps (a) and (b) has a consistency of between 8–20%.

3. A method as recited in claim 2 wherein step (b) is practiced prior to step (a), and wherein step (a) is practiced using a heat transfer medium which is heated by the pulp; and comprising the further step of recovering as useful energy the heat from the heat transfer medium which has been heated by the pulp.

4. A method as recited in claim 2 wherein step (a) is practiced by using low pressure steam as a heat transfer medium in the indirect heat exchanger; and wherein step (a) is practiced at an average pulp velocity of between 0.1–1.0 meters per second.

5. A method as recited in claim 1 comprising the further step of equalizing any temperature differences in the pulp after the heat exchanger by mixing the pulp.

6. A method as recited in claim 5 comprising the further step of adding bleaching chemicals to the pulp so that mixing of the pulp with the bleaching chemicals takes place.

7. A method as recited in claim 1 wherein step (b) is practiced to effect at least one chlorine dioxide, peroxide, ozone, and peracetic acid bleaching.

8. A method as recited in claim 1 wherein step (a) is practiced by using low pressure steam as a heat transfer medium in the indirect heat exchanger.

9. A method as recited in claim 8 wherein (a) and (b) are practiced with pulp at a consistency of between 8–16%.

10. A method as recited in claim 9 wherein step (a) is practiced at an average pulp velocity of between 0.1–1.0 meters per second.

11. A method as recited in claim 10 wherein (a) is practiced so that each portion of the pulp is heated or cooked for less than about one second.

12. A method as recited in claim 1 wherein step (a) is practiced to cool the pulp by using a bleaching chemical as the heat transfer medium in the indirect heat exchanger.

13. A method as recited in claim 12 comprising the further step of adding the bleaching chemical which has been used as a transfer medium to cool the pulp to the pulp before the pulp is introduced into the bleaching reactor.

14. A method as recited in claim 1 wherein step (a) is practiced at an average pulp velocity of between 0.1–1.0 meters per second.

15. A method as recited in claim 1 wherein step (a) is practiced to heat the pulp, and wherein step (b) is practiced to bleach the pulp with at least one of chlorine dioxide, peroxide, peracetic acid, or acid.

16. A method as recited in claim 1 wherein step (a) is practiced to cool the pulp, and wherein step (b) is practiced by bleaching the pulp with at least one of ozone, peroxide, peracetic acid, and chlorine dioxide.

17. A method as recited in claim 1 wherein said at least one bleaching reactor includes at least a peroxide bleaching reactor and a second peroxide bleaching reactor; and wherein step (b) is practiced to cause the pulp to flow into the first peroxide bleaching reactor to effect peroxide bleaching thereof, and then step (a) is practiced to raise the temperature of the pulp, and wherein the method then comprises the further step of feeding the pulp from the indirect heat exchanger to the second peroxide bleaching reactor to effect peroxide bleaching therein.

18. A method as recited in claim 17 wherein the indirect heat exchanger is disposed adjacent a discharge outlet from the first peroxide reactor, within the first peroxide reactor; and wherein step (a) is practiced to heat the pulp prior to discharge from the first reactor.

19. A method as recited in claim 1 wherein step (a) is practiced by using as a heat transfer medium filtrate from a wash or a press, or feed liquor to a pulp digester.

20. A method as recited in claim 1 wherein (a) and (b) are practiced with pulp at a consistency of between 8–16%.

21. A method as recited in claim 20 wherein (a) is practiced to change the temperature of the pulp between 10–30° C.

22. A method as recited in claim 21 wherein step (a) is practiced at an average pulp velocity of between 0.1–1.0 meters per second.

23. A method as recited in claim 22 wherein (a) is practiced so that each portion of the pulp is heated or cooked for less than about one second.

24. A method as recited in claim 1 wherein (a) is practiced so that each portion of the pulp is heated or cooked for less than about one second.

* * * * *